United States Patent [19]

Baker

[11] Patent Number: 5,068,646

[45] Date of Patent: Nov. 26, 1991

[54] DATA DISPLAY

[75] Inventor: Stephen J. Baker, Horley, England

[73] Assignee: U.S. Philips Corp., New York, N.Y.

[21] Appl. No.: 306,283

[22] Filed: Feb. 2, 1989

Related U.S. Application Data

[63] Continuation of Ser. No. 11,075, Feb. 5, 1987, abandoned.

[30] Foreign Application Priority Data

Feb. 17, 1986 [GB] United Kingdom ..... 8603851

[51] Int. Cl.[5] ..... G09G 1/06

[52] U.S. Cl. ..... 340/725; 352/50

[58] Field of Search ..... 340/724, 725, 731, 726, 340/736, 732, 747; 273/DIG. 28; 352/50

[56] References Cited

U.S. PATENT DOCUMENTS

| | | | |
|---|---|---|---|
| 3,747,087 | 7/1973 | Harrison, III et al. | 340/725 |
| 3,874,669 | 4/1975 | Ariano et al. | 340/725 |
| 4,296,930 | 10/1981 | Frederiksen | 340/725 |
| 4,600,919 | 7/1986 | Stern | 340/725 |
| 4,649,380 | 3/1987 | Penna | 340/703 |
| 4,689,616 | 8/1987 | Goude et al. | 340/725 |
| 4,760,390 | 7/1988 | Maine et al. | 340/725 |

FOREIGN PATENT DOCUMENTS

| | | | |
|---|---|---|---|
| 0143485 | 11/1981 | Japan | 340/725 |
| 0171572 | 9/1985 | Japan | 340/725 |
| 2156636 | 10/1985 | United Kingdom | 340/725 |

OTHER PUBLICATIONS

Guttag, K. et al., "Video Display Processor Simulates Three Dimensions", Electronics, Nov. 20, 1980.

*Primary Examiner*—Jeffery A. Brier
*Assistant Examiner*—M. Fatahiyar
*Attorney, Agent, or Firm*—Steven R. Biren

[57] ABSTRACT

A technique for achieving read-time animation in bit-map data displays in apparatus having a display memory in which digital codes are stored to give the color and/or luminance of each pixel of the display and the display memory is accessed repeatedly in a recurrent display scan cycle to read-out the digital codes to produce the display. The time available for modifying the contents of the display memory to achieve animation of an object against a fixed background is very small and access to the display memory for the display scan and for writing-in new digital codes must not be in conflict. The present invention proposes a method of continually modifying the display memory content, to achieve object animation, in which the shape of an object is coded into a machine code program (e.g. by a compiler) before the display is run and then the machine code program is used as a sub-routine as the display is run to move the data for the object shape (with or without modification) to different memory locations of the display memory, with the data for the background areas involved being saved and re-written as the animation progresses and the object shape moves over the background. FIG. 1 shows a block diagram of data display apparatus in which the invention can be embodied.

20 Claims, 5 Drawing Sheets

Fig. 2.

```
1111111111111111.......2222222222222222...........33................
11111111111111111.....222222222222222222.........33................
11..............1111...22..............2222.......33................
11..............1111...22..............2222.......33................
11................11...22................22.......33................
11................11...22................22.......33................
11..................11.22..................22.....33................
11..................11.22..................22.....33................
11..................11.22..................22.....33................
11..................11.22..................22.....33................
11..................11.22..................22.....33................
11..................11.22..................22.....33................
11..................11.22..................22.....33................
11..................11.22..................22.....33................
11................11...22................22.......33................
11................11...22................22.......33................
11..............1111...22..............2222.......33................
11..............1111...22..............2222.......33................
1111111111111111.......2222222222222222...........33................
1111111111111111.......2222222222222222...........33................
11.....................22.........2222...........33................
11.....................22.........2222...........33................
11.....................22..............22.........33................
11.....................22..............22.........33................
11.....................22..............22.........33................
11.....................22..............22.........33................
11.....................22................22.......33................
11.....................22................22.......33................
11.....................22................22.......33................
11.....................22................22.......33................
11.....................22..................22.....33................
11.....................22..................22.....33................
11.....................22..................22.....33................
11.....................22..................22.....33................
11.....................22....................22...33................
11.....................22....................22...33................
11.....................22....................22...33................
11.....................22....................22...33................
11.....................22......................22.33................
11.....................22......................22.33................
11.....................22.......................22.333333333333333333
11.....................22.......................22.333333333333333333
```

DATA DISPLAY

This is a continuation of Ser. No. 07/011,075 filed feb. 5, 1987, now abandoned.

BACKGROUND OF THE INVENTION

The invention relates to a method of displaying a moving object against a fixed background on data display apparatus for displaying as an entity on the screen of a display device a quantity of data which is represented by digital codes stored in a display memory, the displayed data being in the form of discrete pixels or dots each of which has its colour and/or luminance defined by a respective digital code in the display memory at a location corresponding to the position of the pixel in the display, the apparatus including a processor for controlling digitally the storage, selection and display of data including background data.

The invention further relates to digitally operable data display apparatus of a type for displaying as an entity on the screen of a CRT (cathode ray tube) or other display device a quantity of data which is represented by digital codes stored in a display memory.

The displayed data can be, for example, a 320×250 resolution dot matrix colour display and in the case of raster scan display device the digital codes stored in the display memory are accessed repeatedly by the processor to update the display in a recurrent cycle of scanning lines which may be produced with or without interlaced field scanning.

A problem that is encountered with such bit-map displays, as they are termed, is to produce real-time movement (or animation) of an object in the display under logic processor control, because the time available for plotting the object in one position, erasing it, re-plotting the background at that object position and then re-plotting the object at a new position, is very small.

The cycle of logic operations which is required to move an object against a fixed background comprises:

(i) reading out from the relevant memory locations in the display memory the digital data for an area of background corresponding to a new position where the object is to be moved to and storing this data elsewhere to save it, (ii) writing into the display memory at the vacated memory locations the digital data defining the shape of the object, with residual background, if any, (iii) waiting at least one frame (refresh) period to allow the object to be displayed at the new position, (iv) replacing the digital data for the area of background in its original memory locations in the display memory to 'cancel' the object at the position, (v) computing the next position for the object.

In existing data display apparatus, steps (i) and (iv) can involve a known technique of manipulating digital data for the smallest rectangular area of background which the object will fit into. Thus, if the object has an irregular shape, the digital data for more pixels than are strictly necessary has to be manipulated.

It is preferable to do this because the computing time which is necessary to perform the logic decision for deciding to copy or not a pixel is usually longer than the computing time actually required to perform the copy. However, existing systems cannot avoid performing this logic decision for step (ii) in order to enter any residual background in the rectangular space occupied by the object.

SUMMARY OF THE INVENTION

It is an object of the present invention to provide an improved method of moving an object against a fixed background in a data display apparatus.

The invention provides a method of displaying a moving object against a fixed background as set forth in the opening paragraph characterized in that the method comprises generating the object, converting the shape of the object, as initially displayed, into a machine code program, running the program to write into the appropriate locations of the display memory at machine code operating speed of the processor the digital codes which represent the object, and displaying the data represented by the digital codes in the display memory on the screen of the display device By having this facility of generating this machine code program automatically from the object as initially display using, say, a writing tablet, a user can produce the machine code program without the need to be a programmer.

The method of the invention affords the advantage that since all the logic decisions on which pixels to copy (or not to copy) to create the object are taken in advance, that is when the picture to be displayed is initially prepared rather than during the "animated" running of the picture, redundant (background) pixels do not have to be considered.

Additionally, the method of the invention allows advantage to be taken of any unique aspects in the hardware architecture of the processor used for the data display apparatus, for instance an architecture which allows a horizontal strip of pixels (say 4) to be copied using a single machine code instruction.

The net improvement in the speed at which an object can be redefined at successive new positions (animated) in a display depends to a significant extent on the shape of the object. For an object having a simple rectangular shape, the improvement in speed is marginal in comparison with the aforesaid known technique used in an existing data display apparatus. However, for objects of highly complex shapes with holes and irregular outlines, it has been found that the improvement in the speed of operation can be as much as 100 times. The method of the invention does, however, require much more computer memory for the machine code instructions than was hitherto required for the known technique and these instructions take some time to generate.

It is mentioned that alternative known methods of improving the speed of operation of real-time animation in a data display device use a hardware-only approach with either a special processor instruction called a "raster-op" or a dedicated piece of hardware called a "bit-blitter". However, both these known methods are only methods for speeding-up the rectangular area copy and will therefore still be slow compared with the method of the present invention when dealing with irregular shaped objects.

The invention further provides data display apparatus for displaying as an entity on the screen of a display device a quantity of data which is represented by digital codes stored in a display memory, the displayed data being in the form of discrete pixels or dots each of which has its colour and/or luminance defined by a respective digital code in the display memory at a location corresponding to the position of the pixel in the dislay, the apparatus including a processor for controlling digitally the storage, selection and display of data including background data, and movement means for moving an object against a fixed background, said movement means comprising means for converting the shape of the object, as initially displayed, into a machine code program and means for running the machine code program to write into the appropriate locations of the display memory at machine code operating speed of the processor the digital codes which represent the object.

In further considering the nature of the invention, reference will now be made by way of example to the accompanying drawings.

DESCRIPTION OF THE DRAWINGS

FIG. 2 illustrates an object which is to be moved against a fixed background;

DETAILED DESCRIPTION OF THE PREFERRED EMBODIMENTS

Figure 1:
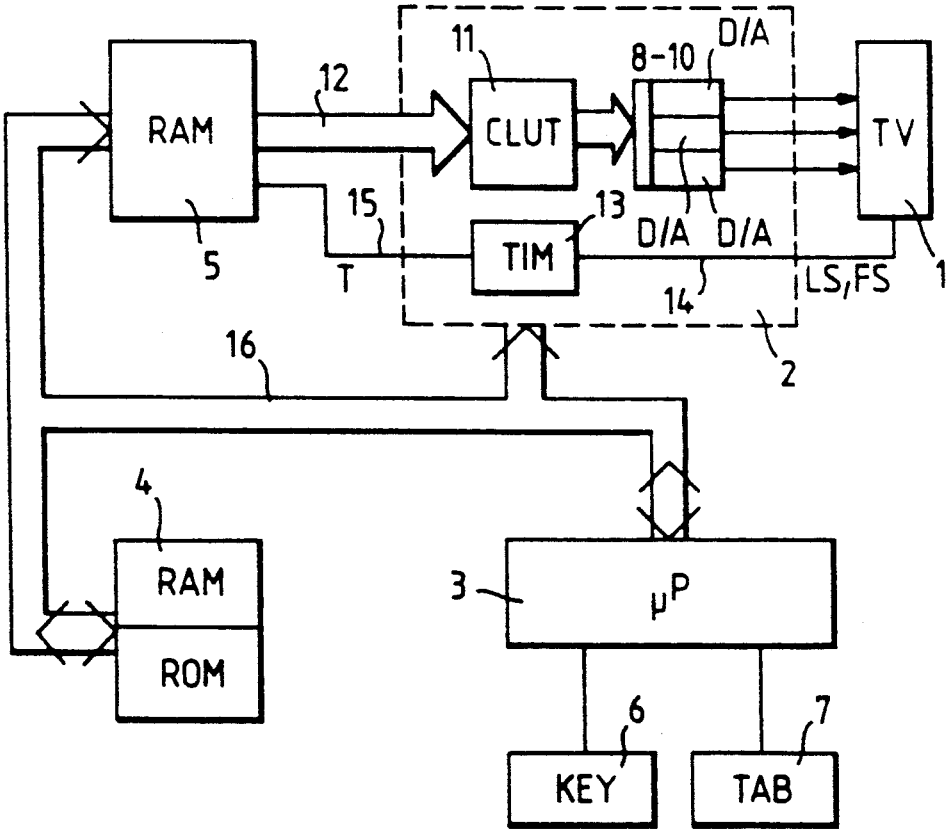
FIG. 1 shows a block diagram of a data display apparatus in which the present invention can be embodied.

Referring to the drawings, the data display apparatus shown in FIG. 1 comprises a display device 1, a display generator 2, a processor 3, a background memory 4, a display memory 5 and user interface apparatus 6 and 7. The display device is suitably a colour television monitor which is connected to receive R, G, B video signals from the display generator 2. These R, G, B video signals are produced in the display generator 2 by three digital-to-analogue converters 8, 9 and 10, respectively. The display generator 2 also includes a colour look-up table 11 which is a read/write memory and is responsive to dot information received from the display memory 5 over a bus 12 to produce digital signals for driving the converters 8, 9 and 10. A display timer 13 in the display generator 2 provides line and field synchronization signals LS and FS for the television monitor 1 over a connection 14. The timer 13 also provides over a connection 15 timing signals T for controlling the transfer of dot information from the display memory 5 to the colour look-up table 11.

The display memory 5 is a random-access memory which has a capacity for storing dot information for at least one display frame. The dot information comprises digital codes composed of one or more bits per dot to be displayed, depending on the range of colours afforded by the colour look-up table 11. A combined address-/data bus 16 interconnects the display generator 2 and the display memory 5 with the processor 3. The background memory 4, which is also at least partially a random-access memory, is also connected to the address/data bus 16. The background memory 4 may also have a read-only memory part which contains permanent program data for controlling the "house-keeping" operations of the processor 3. The user interface apparatus comprises a keyboard data entry device 6 and a writing tablet 7. Such interface apparatus is well-known in the art and specific details thereof are unnecessary for a understanding of the present invention. The processor 3 can be a commercially available microprocessor, for instance, the Signetics S68000 μp.

Consider now the performance of the method according to the invention in displaying an animated object on a standard background.

By means of the writing tablet 7, a user draws a background for display on the screen of the display device 1. The writing tablet 7 can include a colour palette to enable a coloured background to be drawn. The background is displayed as it is being drawn and the digital codes for the pixels which form the display background are stored in the display memory 5. They may also be transferred to the background memory 4 for permanent storage. This process is well-known in the art, as are programmes for implementing it, and will not therefore be elaborated on.

An 'animation' mode selection signal is now entered by the user. This mode gives the user the option of selecting one 'cell' size from a small selection of predetermined 'cell' sizes.

Once the selection has been made the display screen is partitioned into fixed rectangles of that the selected 'cell' size.

The user can now draw an object of any shape within the selected 'cell' size. Conveniently, the object is drawn in the rectangle in the top left-hand corner of the screen and subsequent versions of the object can then be generated automatically in successive other rectangles using a 'replicate' function. The 'replicate' function can be used in conjunction with writing tablet control to make appropriate modifications to the basic shape of the object. The objects are displayed as they are created. The digital codes for all the object shapes created are stored in the background memory 4.

Before a sequence of object shapes as thus created and stored can be displayed to show animation the sequence must first be 'compiled'. This requires the user to specify the initial display position, final display position and duration of each direction vector that the object is to move along, and to specify which set of the pre-drawn 'cells' is to be used for each vector.

In a particular embodiment of the invention using a processor in the 68000 series, the following limitations as to cell size and position are dictated by the 68000 instruction set:

(i) cells must be some multiple of 2 pixels in width.
(ii) cells can only be plotted at even horizontal pixel boundaries.
(iii) cells are restricted in size as determined by the amount of data that can be copied in one frame period.

However, using a processor in the 68020 series should eliminate restrictions (i) and (ii) and allow an increase in cell size as specified in (iii) as the 68020 series have a more flexible instruction set and wider buses.

The animation facilities available to a user should also be able to specify that displayed objects should 'jump' apparently instantaneously from one position to another, and a user should also be able to specify that background should not be replaced after an object has been moved. This allows 'a growing pile of coins' effect to be achieved by initially displaying a 'coin' object at the base of the display and then causing the object to move (slowly) towards the top of the display without replacing the previous object copies by background to eliminate them during the progression. A user should also be able to produce 'a pile of coins' that changes shape as the pile grows, by progressively altering the shape of the object used for the pile. The facility to include a 'GOTO' instruction in a suitable programme sequence would enable a user to generate loops of continuous motion. Such a programme sequence might be:

| | | |
|---|---|---|
| 1. | struct. vector(s) = | determine the direction and limits of object movement along a selected vector. |
| 2. | int. number of posns. = | indicate the number of points along the vector at which the object is to be displayed. |
| 3. | int. x posn = | these two instructions indicate |
| 4. | int. y posn | the co-ordinates of each object display point along the vector. |
| 5. | int. delay = | indicate the number of display frames at which the object is held at each point. |
| 6. | int. leave background? = | this is a decision to replace or not the background at the previous point at which the object was displayed. |
| 7. | vector list = | indicates which vectors are available for execution. |
| 8. | struct. vector GOTO = | this specifies which vector in the "vector list" is to be executed next. |
| 9. | cur. shape = | this indicates which object shape is to be displayed at the current vector point. |
| 10. | struct. shape = | this is a machine code operation for forming the shape of objects in accordance with the invention. This machine code operation is dealt with more fully below. |

The programme sequence would also include some form of loop counter to allow for the eventual termination of loops of motion. Fast moving objects would have the 'delay' set to 0, and x and y position co-ordinates would define only a few spaced-apart points along the vector. Slow moving objects would have the 'delay' set to appropriate non-zero values and the x and y position co-ordinates would define nearly adjacent pixels.

The programme step "(10) struct. shape" is machine code sub-routine which is generated at run-time by a special 'shape compiler' programme from the specification of the cell for an object. The purpose of doing this is to use the 'shape compiler' programme before display commences when time is unimportant. The machine code is then run during display time to generate the data for the object shape in the display memory. The 'shape compiler' analyses the object data in the cells produced by a user and generates one machine code sub-routine for each object shape. These sub-routines all have the same specification and inspect in a first register TARGET the start address of the display memory location corresponding to the current vector point as identified by the relevant x posn and y posn co-ordinates. In second and third registers PBACKGROUND and SBACKGROUND the sub-routines inspect the start address of the display memory locations corresponding to the previous current vector in the primary and secondary displays as identified by the relevant two pairs of x posn and y posn co-ordinates.

Scan synchronization is employed to ensure that writing operations for writing object shapes into the appropriate locations of the display memory do not clash with the cyclic read-out operations from the display memory for the actual display. The problem of achieving scan synchronization is complicated by the fact that the processor has to write two sets of data into the display memory, that is, one set of data to replace the old background at a vector point where an object shape was previously displayed and a second set of data to redefine the object shape at a new vector point.

One solution to this scan synchronization problem is to wait for the display read-out cycle to read past the bottom-most line of an area where an object shape is to be re-written. This will be either the bottom line of the new object shape if the object is moving down the screen, or the bottom line of the old shape if the object is moving up the screen. However, this solution may not be adequate if the object is moving rapidly in a vertical direction from top to bottom because re-writing the background at the top of the screen cannot be started until the display scan has reached the bottom of the screen.

It is possible to distinguish five cases:

CASE I : Upward movement by more than the height of the cell,

CASE II Downward movement by more then the height of the cell (both I & II could have a horizontal component), CASE III: Sideways movement of more than the width of the cell but with a vertical component less than or equal to the height of the cell.

CASE IV : Small movements which result in the new cell overlapping.

CASE V : Background replacement not required.

In the first case one should wait for the scan to pass the new object and plot that, and then ensure that the scan has passed the old object before erasing it with the background. In the second case one must reverse the process. In the third case one need only wait for the lowest of the two cells to be passed. In the fourth case one must be careful to ensure that the old background is replaced before the new object is written. The fifth case is easy because only one cell has to be written.

In addition the compiler could (in principle) calculate the time taken to write the shape and only wait long enough to ensure that display reads and processor writes do not overtake one another. This should mean that one need only wait until the scan has passed (say) halfway down the object before starting to write—being sure that it will have moved on far enough to reach the bottom of the object before the processor. This will have a particularly beneficial effect for short, wide objects where the processor is working much slower than the display system. All this data needs to be compiled into a movement code.

In order to erase the last picture of the object, a standard sized block of background from the place pointed at by the register SBACKGROUND is copied to the place pointed at by the register PBACKGROUND. This may be performed with a fixed sequence of 'MOVEML' instructions of a 68000 series processor because it has already been specified that each cell will start on an even x address and will be some multiple of 4 bytes across.

Object shape coding will be with a mixture of instructions, some using literal data encoded into the instruction, and some being read out of data areas. Where long runs of identical pixels occur 'MOVEML' instructions may be used to advantage and 'holes' or transparent areas of the object should take up little or no code space and execution time.

In order to give an example let it be assumed that the group of letters 'PRL' is to be animated, with each letter drawn in a different colour. Using the symbols 1, 2, 3 to represent the colours and '.' to indicate a transparent background, the display object for this letter group is illustrated in FIG. 2.

The cell required for this letter group PRL comprises approximately a 70×40 pixel rectangle with a fair degree of emptyness and some very short runs. Note that some of these runs are of odd length: this can be achieved with the 68000 processor addressing modes but requires more byte-wide operations. The first three rows of this object cell may be compiled as follows into likely (but not 100% optimal) machine code: it is assumed that an address register A0 points initially at the display memory address for the top left-hand pixel.

```
; ***** ROW 1 *****
    ; 16x colour 01.
    movel 0x01010101,D0      ; Load a colour register D0
                             with 4 pixels
    movel D0,%A0+            ; Dump 4 pixels into the display
                             memory.
    movel D0,%A0+            ; . . . and again
    movel D0,%A0+            ; . . . and again
    movel D0,%A0+            ; . . . and again
    ; 7x background colour
    addq 7,A0                ; Skip 7 pixels - use addq
                             instruction for speed
    ; 16x colour 02.
    movel 0x02020202, D0     ; Load up 4 more pixels
    moveb D0,%A0+            ; Move to even boundary.
    movel D0,%A0+            ; Copy 4 pixels . . .
    movel D0,%A0+            ; . . . and again
    movel D0,%A0+            ; . . . and again
    movew D0,%A0+            ; fill in the odd two
    moveb D0,%A0+            ; and the last one.
    ; 11x background colour
    adda 11,A0               ; cannot use addq here.
    ; 2x colour 03.
    movew 0x0303,%A0+        ; short runs are carried out
                             directly.
    ; 16x background colour
    ; Back to start of row
    ; On to next line
    adda MAXX+16-68,A0
; ***** ROW 2 *****
    ; 18x colour 01.
    movel 0x01010101,D0
    movel D0,%A0+
    movel D0,%A0+
    movel D0,%A0+
    movel D0,%A0+
    movew D0,%A0+
    ; 5x background colour
    addq 5,A0
    ; 18x colour 02.
    movel 0x02020202,D0
    moveb D0,%A0+
    movel D0,%A0+
    movel D0,%A0+
    movel D0,%A0+
    movel D0,%A0+
    moveb D0,%A0+
    ; 9x background colour
    adda 9,A0
    ; 2x colour 03.
    movew 0x0303,%A0+
    ; 16x background colour
    ; Back to start of row
    ; On to next line
    adda MAXX+16-68,A0
; ***** ROW 3 *****
    ; 2x colour 01
    movew 0x0101,%A0+
    ; 14x background colour
    adda 14,A0
    ; 4x colour 01
    movel 0x01010101,%A0+
```

-continued

```
    ; 3x background colour
    addq 3,A0
    ; 2x colour 02
    moveb 0x02,%A0+
    moveb 0x02,%A0+
    ; 14x background colour
    adda 14,A0
    ; 4x colour 02
    movel 0x02020202,D0
    moveb D0,%A0+
    movew D0,%A0+
    moveb D0,%A0+
    ; 7x background colour
    addq 7,A0
    ; 2x colour 03
    movew 0x0303,%A0+
    ;16x background colour
    ; Back to start of row
    ; On to next line
    adda MAXX+16-68,A0
    ; . . . etc . . .
```

The sequence above takes the following amount of time:

| Row No. | CPU Clock Periods | Program reads | Display writes |
|---|---|---|---|
| 1 | 12 | 21 | 18 |
| 2 | 12 | 22 | 20 |
| 3 | 20 | 17 | 9 |
| total | 44 | 60 | 47 |

Assuming no interrupts and nit-wait-state program emory there is a total of 284 clock periods plus the time taken to write 47 words into display memory since each program read takes four clock cycles. Assuming these three lines to be typical (a pessimistic assumption) then the entire 43 lines object would take 4,000 clock periods plus 670 display memory cycles.

With an 8 Mhz 68000 processor the programme memory component takes up 500 μs but the time taken for the display cycles may not be easy to determine due to the VME bus overhead and the statistical nature of processor access/display access collisions. A worst case situation for a display access is when the processor attempts to write a pixel or pair of pixels during the active line time. Under these circumstances the processor will be held in a wait state for at most 8 clock periods and the access itself can take a further 8 clock periods (this includes the VME bus overhead). The display subsystem clock runs at 13.5 MHz so that an access during the 52 μs active line time could take as long as 1.2 μs. During the 12 μs line blanking period and during the whole of frame blanking the worst case access of 0.6 μs.

The improved access times during frame blanking will be ignored for the moment because drawing will be scan-synchronised and most accesses will therefore be during normal display lines. This gives a likely average access time of $$(1.2\times 52+0.6\times 12)/64\ \mu s=1.1\ \mu s$$

Thus 670 display cycles will take of the order to 740 μs giving a : total time for drawing the object shape of 1,240 μs.

The time taken to redraw the background will be roughly two MOVEML instructions for every (approx) 40 pixels horizontally, plus to ADD instructions at the end of each line—All of this must then be multiplied by the number of pixels vertically. For the example object shape this means 160 MOVEML's plus 80 ADD's. A total of 482 instruction reads +3,200 CPU clock periods +6,400 display read/write operations. This make a total of 641 μs of processor +7,040 μs of display access time for the MOVEML's plus 160 instruction reads (=20 μs) for the ADD's.

This object can thus be rewritten against any background in approximately 9 ms. Assuming that the scan synchronization takes negligible time and works sufficiently well then it may be predicted that objects up to about twice this size could be animated. (150 pixels by 40 or 70 by 80 pixels).

Using a 10 MHz processor rather than an 8 MHz processor will not improve the speed of display cycles but will speed up processor and instruction read operations. This means that the 9 ms. redraw time given above could be reduced by about 250 μs. a 2 to 3% improvement!

The overriding criterion for speed seems to be the time taken to actually access the display memory, so decreasing the number of pixels read/written from there would be beneficial. However, since all the pixels for the object shape itself must be re-written, the only possible optimization could be from the background replacement operation. As can be seem from the calculations above, most time, at least in the example given, is spent in re-writing the background for the object.

One could (for some object shapes) only replace the background in those pixels that were actually changed. This would mean compiling a code sequence similar to the one used for writing the object except that the pixel colour information would have to be read from a second display memory instead of being built into the code itself. This approach is only of use when, as in the example above, the object itself has many 'holes'. A very clever compiler should examine both possibilities and choose the fastest approach on a shape-by-shape basis.

One could optimize the object writing sequence still further by noting the contents of the registers after one row of dots has been processed so that reloading them is unnecessary when a run of one colour is followed by a gap and then a run of some other colour.

In addition, use could be made of more registers to remember more of the colours involved so that some improvement could be expected for patterns with less than, say, 8 colours. This might produce a 1% or 2% improvement in performance for some objects.

Another possibility would be to write the object shape out from right to left, using auto-decrement instructions to move the address register, in which case very long runs might be made more efficient both in time and memory usage by use of the MOVEML instruction, although this would require more registers for storing colour data if the previous optimization were employed.

A doubling of performance could be achieved by only animating on a field-by-field basis. This would mean only writing to every alternate line of the display memory. It might also mean forcing the motion of the cell to steps of two pixels vertically which might look jerky for very slow speed motion. A more complex sequence of events as follows would be needed for alternate field animation:

-continued

```
Wait for an even field.
if (background replacement specified)
  if (object and background overlap or object moving
    downwards)
    wait for scan to pass background
    fill even lines of background
    make sure scan has passed object
    fill even lines of object
  else
    wait for scan to pass object
    fill even lines of object
    make sure scan has passed background
    fill even lines of background
else
  wait for scan to pass object
  fill even lines of object
Make sure the odd field has arrived.
if (background replacement specified)
  if (object and background overlap or object moving
    downwards)
    wait for scan to pass background
    fill odd lines of background
    make sure scan has passed object
    fill odd lines of object
  else
    wait for scan to pass object
    fill odd lines of object
    make sure scan has passed background
    fill odd lines of background
else
  wait for scan to pass object
  fill odd lines of object
Collect coordinates for next position
Delay for required number of frames.
```

One could re-calculate the co-ordinates of the object between fields to overcome the jerky nature of slow-speed motion but this might have unfortunate effects if the object is moving at speeds around 2 pixels per frame because only the even numbered lines of the object would ever be seen. This corresponds to an object which would travel the height of the screen in 11.5 seconds which is probably much slower than one is likely to be concerned about.

Although the user would be required to fit the object shape into one of a range of standard sized cells, the object compiler really only needs to standardize the width of objects so that the MOVEML instruction may be used efficiently to replace the background. Matters could also be improved by taking the actual height of the object into consideration when re-writing the background.

If the horizontal resolution of an object could be reduced by a factor two so that all runs of identical pixels were of even length, then every run would start on an even boundary and there would never by any need to generate wasteful MOVEB instructions at the start and end of sequences that are either of odd length, or worse, that the start on an odd byte boundary.

Where an immediate MOVEB instruction is followed by another immediate MOVEB instruction, when there is a run of one colour ending on an odd byte boundary, followed by a run in a different colour, this would be optimized to an immediate MOVEW instruction. This would improve performance only marginally for simple objects or objects with many holes but would show a reasonable improvement for complex, multi-coloured objects.

With these improvements one could perhaps hope to animate 120×100 pixel objects smoothly and without flicker, bearing in mind that the shape of the object can be changed on a frame-by-frame basis. The speed of the technique depends very heavily on the complexity of the object that is being animated. An object with big 'holes' in it can be much larger than a dense, multicoloured object.

Figure 3:
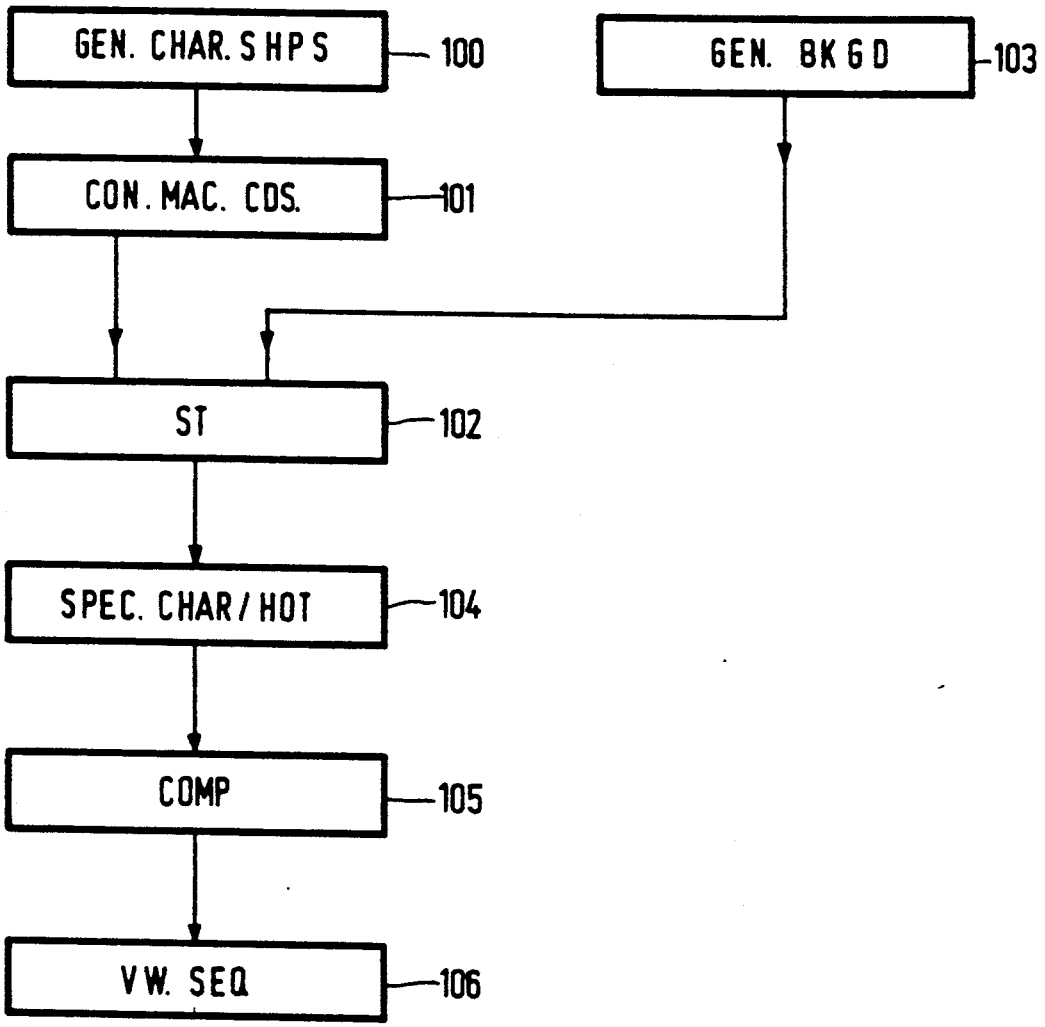
FIG. 3 is a flow diagram illustrating a method of displaying a moving object according to the invention and which may be implemented in apparatus as shown in FIG. 1.

FIG. 3 is a flow diagram illustrating a method of displaying a moving object against a fixed background. The first step, shown in box 100 (GEN.CHAR.SHPS.), of the method is to generate one or more object or character shapes. These shapes are then converted into a machine code program, box 101 (CON.MAC.CDS) and the machine code program for each shape is stored in the background memory, box 102 (ST). A background scene against which the motion is to be effected is generated, box 103 (GEN.BKGD) and stored. The generation of the object shapes and background may be effected by the user with the aid of the interface apparatus 6 and 7 which could also include apparatus for digitizing real scenes for background use, for example originating from video tape or video disc players. The user then specifies the motion of the object or character, box 104 (SPEC. CHAR/MOT). This will include the start and stop positions, the speed of motion and the vectors along which the motion is to take place. This information is compiled, box 105 (COMP), by combining the selected shape(s), background, and motion. This compiled sequence is then fed to the RAM5 to be passed to the display screen to enable the sequence to be viewed, box 106 (VW.SEQ.).

Figure 4:
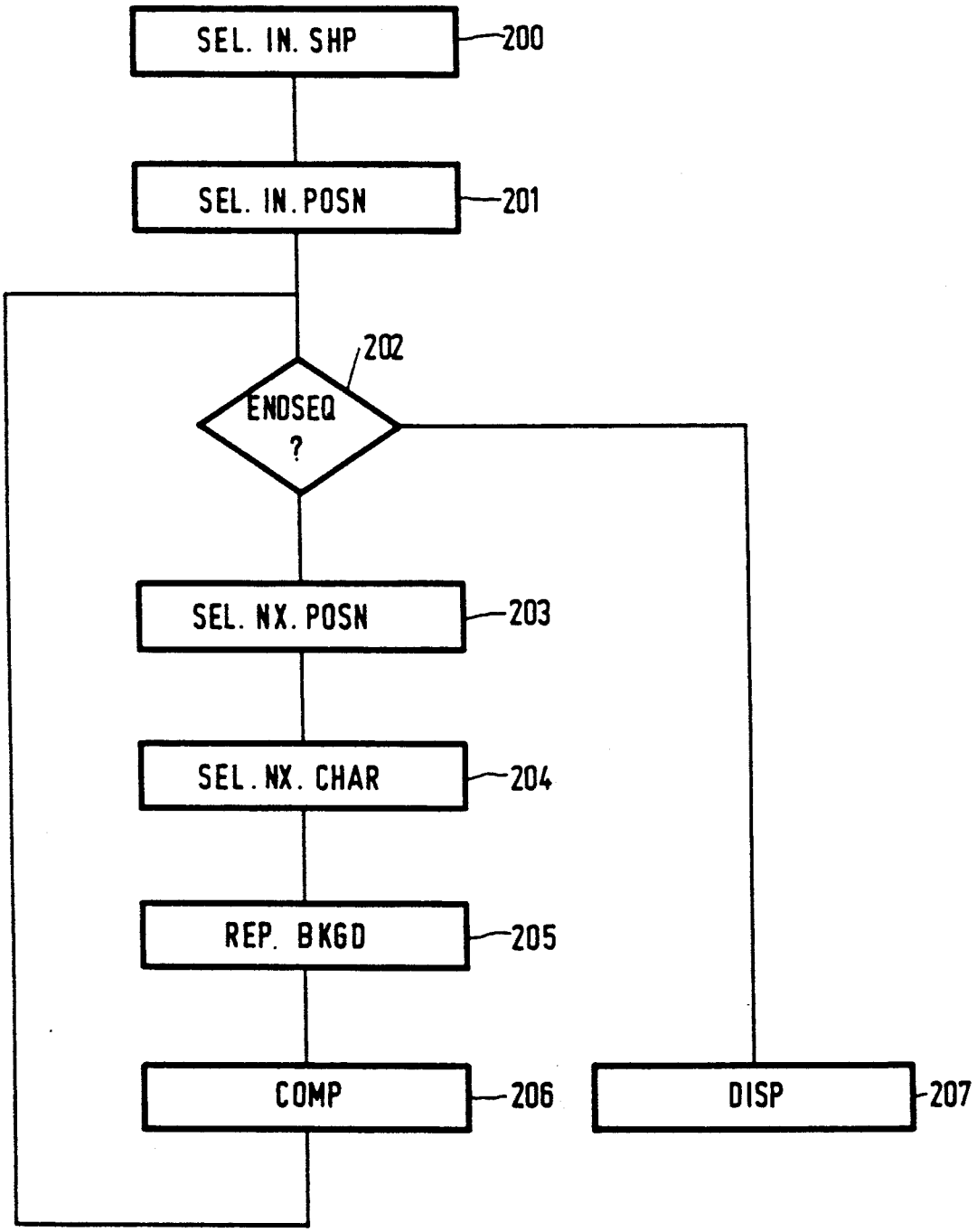
FIG. 4 is a flow diagram showing part of the diagram of FIG. 3 in greater detail.

FIG. 4 illustrates in greater detail the steps represented by boxes 104 to 106 in FIG. 3. Box 200 (SEL-.IN.SHP) represents the selection of a particular object which is to be moved against the fixed background and box 201 (SEL.IN.POSN) represents the setting of the initial position of the object. A decision, box 202 (END-SEQ?), is then taken as to whether the movement sequence has been completed. If not, then the next object position is specified, box 203 (SEL.NX.POSN) and the next object shape is also specified, box 204 (SEL.NX.-CHAR). Clearly the object shape and object position may both be changed or one of the shape and position may be kept constant with the other changed. In each case the next step of the method is to generate the code for replacing the background where the object was last displayed, box 205 (REP.BKGD), followed by the step of compiling the code required to enable the information defining that picture of the sequence to be entered into the display memory and storing the compiled code in the background memory, box 206 (COMP). The decision, box 202, as to whether the motion sequence has ended is again taken and the procedure repeated until the end of the sequence of pictures is reached. When the sequence has been compiled and stored the user can call up the compiled code which represents the series of pictures, box 207 (DISP). The compiled code causes each picture of the sequence to be generated and stored in the display memory (RAM5) in turn to enable the sequence of pictures to be displayed on the display device 1.

Figure 5:
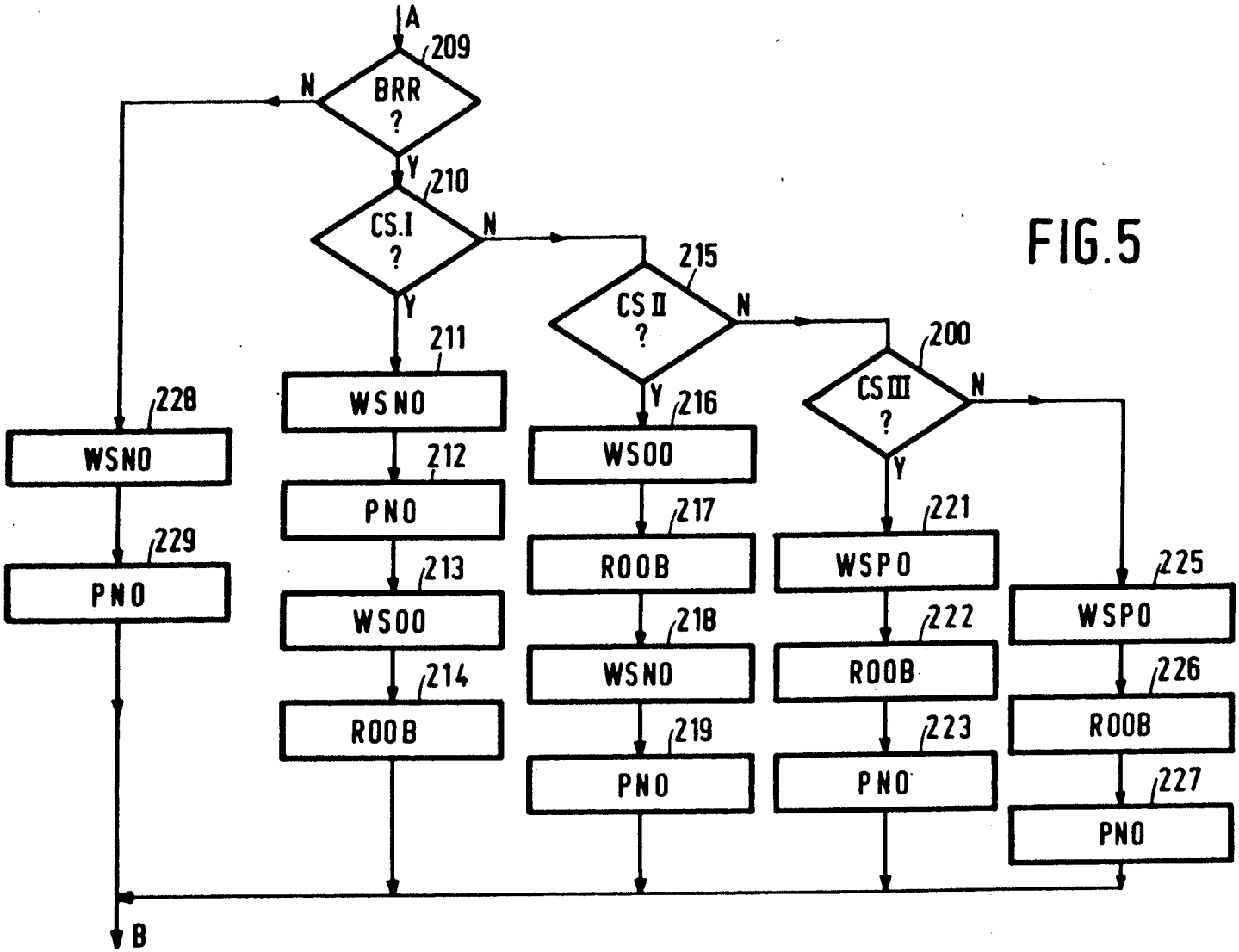
FIG. 5 is a flow diagram illustrating a scan synchronisation technique which may be included in the method according to the invention.

FIG. 5 illustrates the scan synchronization techiques discussed hereinbefore. This sequence is entered at A from box 204 (SEL.NX.CHAR) shown in FIG. 4 and starts with a decision as to whether background replacement is required, box 209 (BRR?). If background replacement is required then a decision is made as to whether the new character position gives rise to CASE I, box 210 (CS.1?). If it does then the next step is to wait until the scan has passed the new object position, box 211 (WSNO). The new object is then written into the appropriate part of the RAM5, box 212 (PNO.). The next step is to wait until the scan has passed the old object position, box 213 (WSOO). The old object is then replaced by the background which had previously been stored, box 214 (ROOB). The exit B re-enters FIG. 4 at the input of decision box 202.

If it is determined that the new character position does not give rise to CASE I, then a decision as to whether CASE II is applicable, box 215 (CS.II?). If this is so then the next step is to wait until the scan has passed the old object, box 216 (WSOO) and then to replace the old object by the background which had previously been stored, box 217 (ROOB). The next step is to wait until the scan has passed the position of the new object, box 218 (WSNO) and then write the new object into the appropriate part of the RAM5, box 219 (PNO).

If it is determined that the new object position gives rise to CASE III, box 220 (CS.III?), then the next step is to wait for the scan to pass the position of the lowest of the old and new objects, box 221 (WSPO). Then the old object is replaced by the background, box 222 (ROOB), and the new object is written in to the appropriate part of the RAM5, box 223 (PNO).

If background replacement is required and the object movement does not give rise to any of CASES I, II and III then it must give rise to CASE IV. The first step is then to wait for the scan to pass the position of the lowest of the old and new object positions, box 225 (WSPO). The old object is then replaced by the background, box 226 (ROOB) and the new object written into the appropriate part of the RAM5, box 227 (PNO).

It should be noted that in CASE IV it is necessary to replace the old object with the background before writing the new object whereas in CASE III it is immaterial in which order these two steps are taken.

If background replacement is not required (CASE V) then all that is required is to wait for the scan to pass the new object position, box 228 (WSNO), and then to write the new object into the appropriate part of the RAM5, box 229 (PNO).

From reading the present disclosure, other modifications will be apparent to persons skilled in the art. Such modifications may involve other features which are already known in the design and use of data display apparatus and devices and component parts thereof and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation or modification of one or more of those features which would be obvious to persons skilled in the art, whether or not it relates to the same invention as presently claimed in any claim and whether or not it mitigates any or all of the same technical problems as does the present invention. The applicants hereby given notice that new claims may be formulated to such features and/or combinations of such features during the prosecution of the present application or of any further application derived therefrom.

I claim:

1. A method of displaying a moving object against a fixed background on data display apparatus for displaying as an entity on a screen of a display device a quantity of data which is represented by digital codes stored in a display memory, said displayed data being in the form of discrete pixels or dots each of which has at least one of its color and luminance defined by a respective digital code in said display memory at a location corresponding to the position of the pixel in the display, said data display apparatus including a processor for controlling digitally the storage, selection and display of data including background data, said method comprising:

a) generating the object as a display;

b) converting the shape of the object, as initially displayed, into a machine code program capable of generating digital data display code;

c) during a recurrent display scan cycle, running the machine code program to write into appropriate locations of the display memory at machine code operating speed of said processor the digital data display codes which represent the object, said digital data display codes being generated by said machine code program; and d) displaying on the screen of the display device the data represented by the digital data display codes in the display memory.

2. A method according to claim 1, wherein:

said step of generating the object comprises creating an object shape on the display screen with one of a writing tablet and another user interface means, and using a compiler program to generate a machine code program from data defining said object shape.

3. A method according to claim 2, further comprising:

e) using a scan synchronization technique to avoid conflict between read-out from the display memory for the display and writing into the display memory the data for both new object shapes and background areas which replace old object shapes.

4. A method according to claim 1, further comprising:

e) using a scan synchronization technique to avoid conflict between read-out from the display memory for the display and writing into the display memory the data for both new object shapes and background areas which replace old object shapes.

5. A method according to claim 1, wherein:

animation of an object shape is achieved on a field-by-field basis by writing only to memory locations in the display memory that correspond to alternate display lines.

6. A method according to claim 2, wherein:

animation of an object shape is achieved on a field-by-field basis by writing only to memory locations in the display memory that correspond to alternate display lines.

7. A method according to claim 4, wherein:

animation of an object shape is achieved on a field-by-field basis by writing only to memory locations in the display memory that correspond to alternate display lines.

8. A method according to claim 1, further comprising:

e) rewriting the background data into the display memory in locations from which the moving object has moved.

9. A method according to claim 8, wherein:

the background data is only rewritten into locations in the display memory defining the shape and position of the moving object in the previous display frame.

10. A method according to claim 2, further comprising:

e) rewriting the background data into the display memory in locations from which the moving object has moved.

11. A method according to claim 10, wherein:

the background data is only rewritten into locations in the display memory defining the shape and position of the moving object in the previous display frame.

12. A method according to claim 7, further comprising:

e) rewriting the background data into the display memory in locations from which the moving object has moved, wherein the background data is only rewritten into locations in the display memory defining the shape and position of the moving object in the previous display frame.

13. Data display apparatus for displaying as an entity on the screen of a display device a quantity of data which is represented by digital codes stored in a display memory, the displayed data being in the form of one of discrete pixels and dots each of which has at least one of its color and/or luminance defined by a respective digital code in the display memory at a location corresponding to the position of the pixel in the display, the apparatus comprising:

a) a processor for controlling digitally the storage, section and display of data including background data; and b) movement means for moving an object against a fixed background, said movement means comprising means for converting the shape of the object, as initially display, into a machine code program capable of generating digital data display code, and means during a display cycle for running the machine code program to write into the appropriate locations of the display memory at machine code operating speed of the processor, the digital data display codes which represent the object, said digital data display codes being generated by said machine code program.

14. Data display apparatus according to claim 13, wherein:

said processor comprises a compiler program for generating the machine code program from data generated by a user creating the object shape on the display screen with one of a writing tablet and another user interface means.

15. Data display apparatus according to claim 14, wherein data is displayed on the display screen by line and field scanning, said data display apparatus further comprising:

c) means for synchronizing the scanning of the display screen and the access to the display memory to avoid conflict between read-out from the display memory for the display and writing into the display memory the data for both new object shapes and background areas which replace old object shapes.

16. Data display apparatus according to claim 13, wherein data is displayed on the display screen by line and field scanning, said data display apparatus further comprising:

c) means for synchronizing the scanning of the display screen and the access to the display memory to avoid conflict between read-out from the display memory for the display and writing into the display memory the data for both new object shapes and background areas which replace old object shapes.

17. Data display apparatus according to claim 13, wherein the animation of an object shape is achieved on afield-by-field basis, the data display apparatus further comprising:

c) means for writing only to memory locations in the display memory that correspond to alternate display lines.

18. Data display apparatus according to claim 14, wherein the animation of an object shape is achieve don a field-by-field basis, the data display apparatus further comprising:

c) means for writing only to memory locations in the display memory that correspond to alternate display lines.

19. Data display apparatus according to claim 15, wherein the animation of an object shape is achieved on a field-by-field basis, the data display apparatus further comprising:

d) means for writing only to memory locations in the display memory that correspond to alternate display lines.

20. Data display apparatus according to claim 16, wherein animation of an object shape is achieved on a field-by-field basis, the data display apparatus further comprising:

d) means for writing only to memory locations in the display memory that correspond to alternate display lines.

* * * * *